US010745930B2

(12) United States Patent
Newman

(10) Patent No.: US 10,745,930 B2
(45) Date of Patent: Aug. 18, 2020

(54) TRANSPORTABLE CONTAINED TOWER SYSTEM

(71) Applicant: Jerry Newman, Spangle, WA (US)

(72) Inventor: Jerry Newman, Spangle, WA (US)

(73) Assignee: Peak Industries, Inc., Spokane, WA (US)

( * ) Notice: Subject to any disclaimer, the term of this patent is extended or adjusted under 35 U.S.C. 154(b) by 0 days.

(21) Appl. No.: 15/900,209

(22) Filed: Feb. 20, 2018

(65) Prior Publication Data

US 2018/0274258 A1 Sep. 27, 2018

Related U.S. Application Data

(60) Provisional application No. 62/460,230, filed on Feb. 17, 2017.

(51) Int. Cl.

| | |
|---|---|
| ***E04H 12/20*** | (2006.01) |
| ***E04B 1/34*** | (2006.01) |
| ***E04H 12/18*** | (2006.01) |
| ***E04B 1/343*** | (2006.01) |
| ***H01Q 1/10*** | (2006.01) |
| ***H01Q 1/12*** | (2006.01) |
| *E04H 1/12* | (2006.01) |

(52) U.S. Cl.

CPC ..... *E04H 12/182* (2013.01); *E04B 1/34305* (2013.01); *E04B 1/34352* (2013.01); *H01Q 1/10* (2013.01); *H01Q 1/1235* (2013.01); *E04B 1/34* (2013.01); *E04B 2001/34394* (2013.01); *E04H 12/20* (2013.01); *E04H 2001/1283* (2013.01)

(58) Field of Classification Search

CPC ..... E04H 12/182; E04H 12/20; E04H 2001/1283; E04B 1/34305; E04B 1/34352; E04B 2001/34394; E04B 1/34; H01Q 1/10; H01Q 1/1235

USPC ..... 52/79.5, 118, 111, 116, 117, 40

See application file for complete search history.

(56) References Cited

U.S. PATENT DOCUMENTS

| | | | | |
|---|---|---|---|---|
| 4,181,929 A * | 1/1980 | Barber | F21S 9/022 | 248/167 |
| 4,913,458 A * | 4/1990 | Hamilton | B60R 11/04 | 212/304 |
| 4,934,396 A * | 6/1990 | Vitta | E04H 1/1277 | 135/139 |
| 5,434,614 A * | 7/1995 | Dainty | H04N 5/232 | 348/144 |
| 5,558,112 A * | 9/1996 | Strieter | B08B 15/026 | 134/103.2 |
| 5,671,900 A * | 9/1997 | Cutler | A47B 23/007 | 248/448 |

(Continued)

*Primary Examiner* — Phi Dieu Tran A

(74) *Attorney, Agent, or Firm* — Lee & Hayes, P.C.

(57) ABSTRACT

This invention discloses a tower system in which a telescoping tower with a plurality of tower structures is contained within a rigid transportation container in a substantially horizontal position for transportation, may be extended to a height much greater than its contracted length. The tower may be transported horizontal, repositioned to a vertical position and then the individual tower structures extended and secured via spring pins relative to the adjacent tower structure, the erection of the tower sections may be with external equipment such as a boom truck, or utilizing an internal hydraulic cylinder.

8 Claims, 19 Drawing Sheets

(56) References Cited

U.S. PATENT DOCUMENTS

| | | | | | |
|---|---|---|---|---|---|
| 5,718,087 | A * | 2/1998 | Featherstone | E04H 12/182 | 52/108 |
| 5,850,713 | A * | 12/1998 | Hojo | B66F 3/28 | 52/115 |
| 6,000,175 | A * | 12/1999 | Gale | E04H 15/58 | 135/122 |
| 6,253,502 | B1 * | 7/2001 | Layton | H01Q 1/3216 | 212/180 |
| 6,383,242 | B1 * | 5/2002 | Rogers | B01D 46/42 | 454/63 |
| 6,513,299 | B1 * | 2/2003 | Damiano | E04H 12/10 | 343/874 |
| 7,089,705 | B1 * | 8/2006 | Lieberman | E04H 12/187 | 248/670 |
| 7,188,636 | B1 * | 3/2007 | Kanne | B08B 15/02 | 135/142 |
| 7,299,531 | B2 * | 11/2007 | Staples | G01B 3/08 | 29/434 |
| 7,788,858 | B1 * | 9/2010 | Ammons | B66C 23/44 | 212/180 |
| 7,866,332 | B1 * | 1/2011 | Mizrahi | B66C 23/48 | 134/200 |
| 7,989,979 | B2 * | 8/2011 | Burgess | B60Q 1/245 | 307/10.1 |
| 8,276,326 | B2 * | 10/2012 | Lounis | B66F 11/00 | 212/199 |
| 9,748,639 | B2 * | 8/2017 | Newman | H01Q 1/1235 | |
| 2004/0237423 | A1 * | 12/2004 | Carter | E04H 15/50 | 52/79.1 |
| 2005/0097833 | A1 * | 5/2005 | Campbell | H01Q 1/10 | 52/118 |
| 2006/0201076 | A1 * | 9/2006 | Blackwelder | E04H 12/182 | 52/118 |

* cited by examiner

TRANSPORTABLE CONTAINED TOWER SYSTEM

CROSS REFERENCE TO RELATED APPLICATION

This application claims priority to U.S. Provisional Application Ser. No. 62/460,230, filed Feb. 17, 2017.

TECHNICAL FIELD

This invention relates to a transportable contained tower system for providing a portable erectable tower system which can more easily be moved from one location to another using a standard but modified metal steel shipping container. This invention has numerous potential tower applications, such as among others, use for cell phone towers and antennas.

BACKGROUND OF THE INVENTION

The proliferation of the usage of cell phones around the world has created a strong demand for additional cell phone coverage and hence additional towers carrying cell phone antennas. In some cases the demand requires a temporary cell phone tower before permanent can be installed, and others there may only be a temporary need for the cell phone tower. In some cases the temporary tower system may be used on a more permanent basis.

For many reasons the cell phone towers need to be placed in locations which are not readily accessible for equipment and it is desirable to have a mobile system in which the tower can be driven directly to the location where it's to be installed and cranes or other heavy equipment are not necessary to get the tower to the specific location. In some circles the tower systems are referred to as COWS, which stands for cells on wheels.

Shipping the towers to remote locations can be too time and resource intensive. On the other hand, there are new and used prefabricated standard shipping containers, typically made of steel, which are generally readily available and relatively inexpensive. Therefore, there has been a long felt but unsatisfied need for a sufficiently expandable tower system which can be fit within a standard shipping container for shipping, but which is also sufficiently expandable in remote locations to meet the needs of an installed temporary, semi-permanent or permanent tower system.

The needs of a remote tower system further include the need for electronics, cooling and other known components needed for such tower systems, which also need to be delivered to such locations and included within or attached to said modified standard steel shipping containers.

It is therefore an objective of aspects of this invention to provide a transportable contained tower system which utilizes a standardized steel shipping container for shipping and containment, and which then may be used as part of the tower anchor or framework for the tower as installed.

It is another objective of aspects of this invention to provide such a tower system as described in the preceding paragraph and further wherein the tower may be shipped in a supported horizontal or substantially horizontal orientation within the shipping container, but then may be re-oriented to a vertical position for the use and/or operation of the tower.

Embodiments of this invention provide such a tower system and have advantage of a fully self-contained tower system, including other tower system required or desired components, which can be housed by or attached to the contained tower system as transported.

While the invention was motivated in addressing some objectives, it is in no way so limited. The invention is only limited by the accompanying claims as literally worded, without interpretive or other limiting references to the specification, and in accordance with the doctrine of equivalents.

Other objects, features and advantages of this invention will appear from the specification, claims, and accompanying drawings which form a part hereof. In carrying out the objects of this invention, it is to be understood that it's essential features are susceptible to change in design and structural arrangements, with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms a, an, and the as used in the claims herein are used in conformance with long-standing claim drafting practice and not in a limiting way. Unless specifically set forth herein, the terms a, an, and the, are not limited to one of such elements, but instead mean "at least one.

As will be appreciated by those of reasonable skill in the art, there are numerous embodiments to this invention, and variations of elements and components which may be used, all within the scope of this invention.

It will be appreciated by those of ordinary skill in the art that while one of a plurality of standardized steel containers may be utilized to practice embodiments of this invention, this is not required and a custom build container may also be used, all as contemplated by embodiments of this invention. It will be further appreciated that while standard steel containers are plentiful and preferred, other materials may be utilized within the contemplation of this invention, such as alloys, aluminum, plastics, composites, and others.

Figure 1:
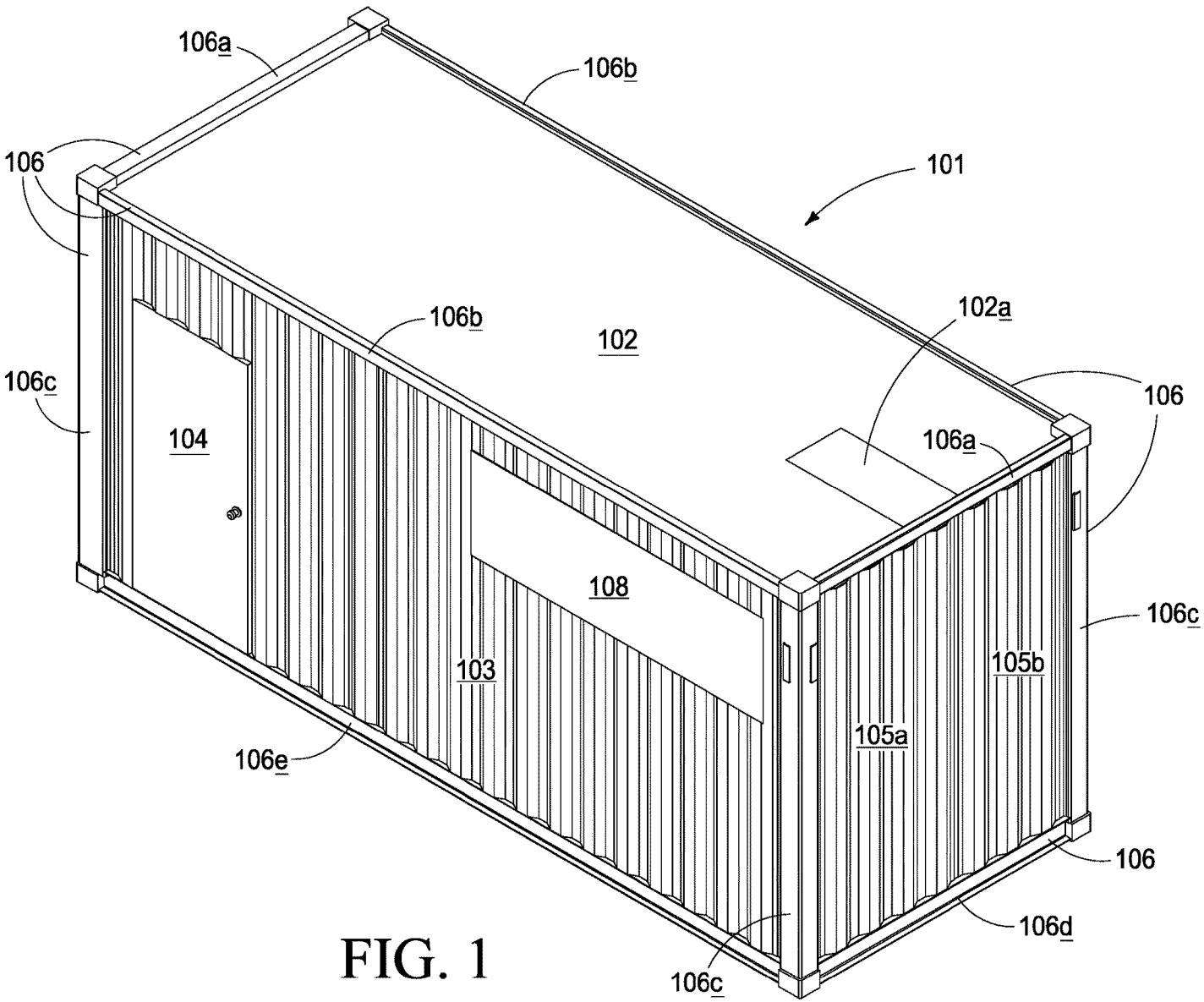
FIG. 1 is a perspective view of one example of an embodiment of this invention.

FIG. 1 is a perspective view of one example of an embodiment of this invention, illustrating a modified shipping container or steel shipping container 101, with the top 102, front side 103, tower aperture cover 102*a*, container first end 105*a* and 105*b*, door 104, front side opening 108, and framework 106 which may include upper end framework portions 106*a*, upper front and rear framework portions 106*b*, lower framework portion 106*d*, and corner framework portions 106*c*. FIG. 1 shows exemplary modifications to an example of a steel shipping container or just shipping container, which may be made to practice some embodiments of this invention (though not required to practice the invention).

Figure 2:
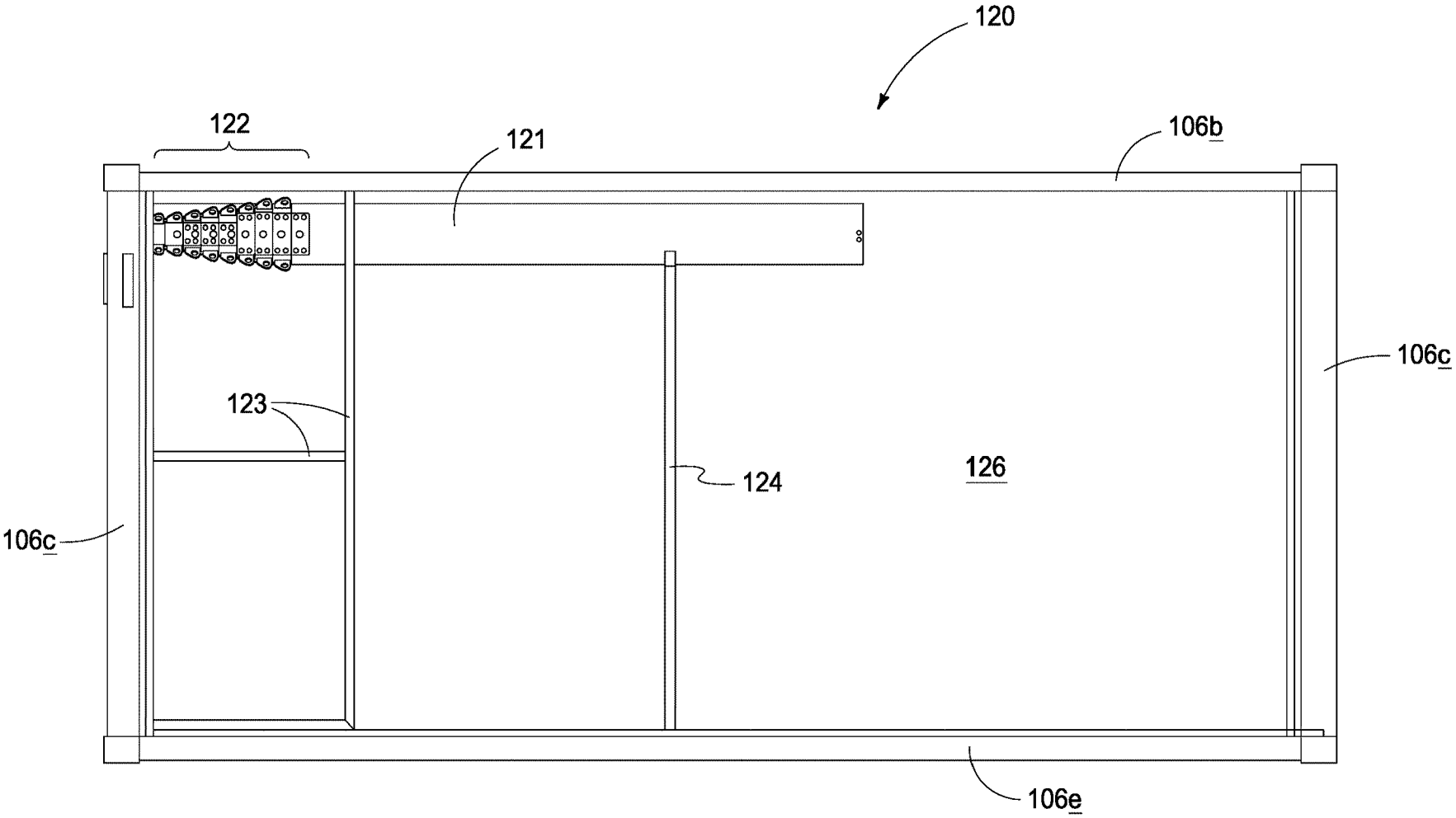
FIG. 2 is a front inside elevation view of an example of an embodiment contemplated by this invention, illustrating a tower mounted within a container.

FIG. 2 is a front inside elevation view of an example of an embodiment with a modified shipping container structure 120 which may be utilized as contemplated by this invention, illustrating a tower 121 mounted within the shipping container 120, supported by internal framework 123 and 124. FIG. 2 further illustrates the internal compartment 126 of the shipping container, corner framework portions 106*c*, upper framework portion 106*b* and lower framework portion 106*e*.

Figure 3:
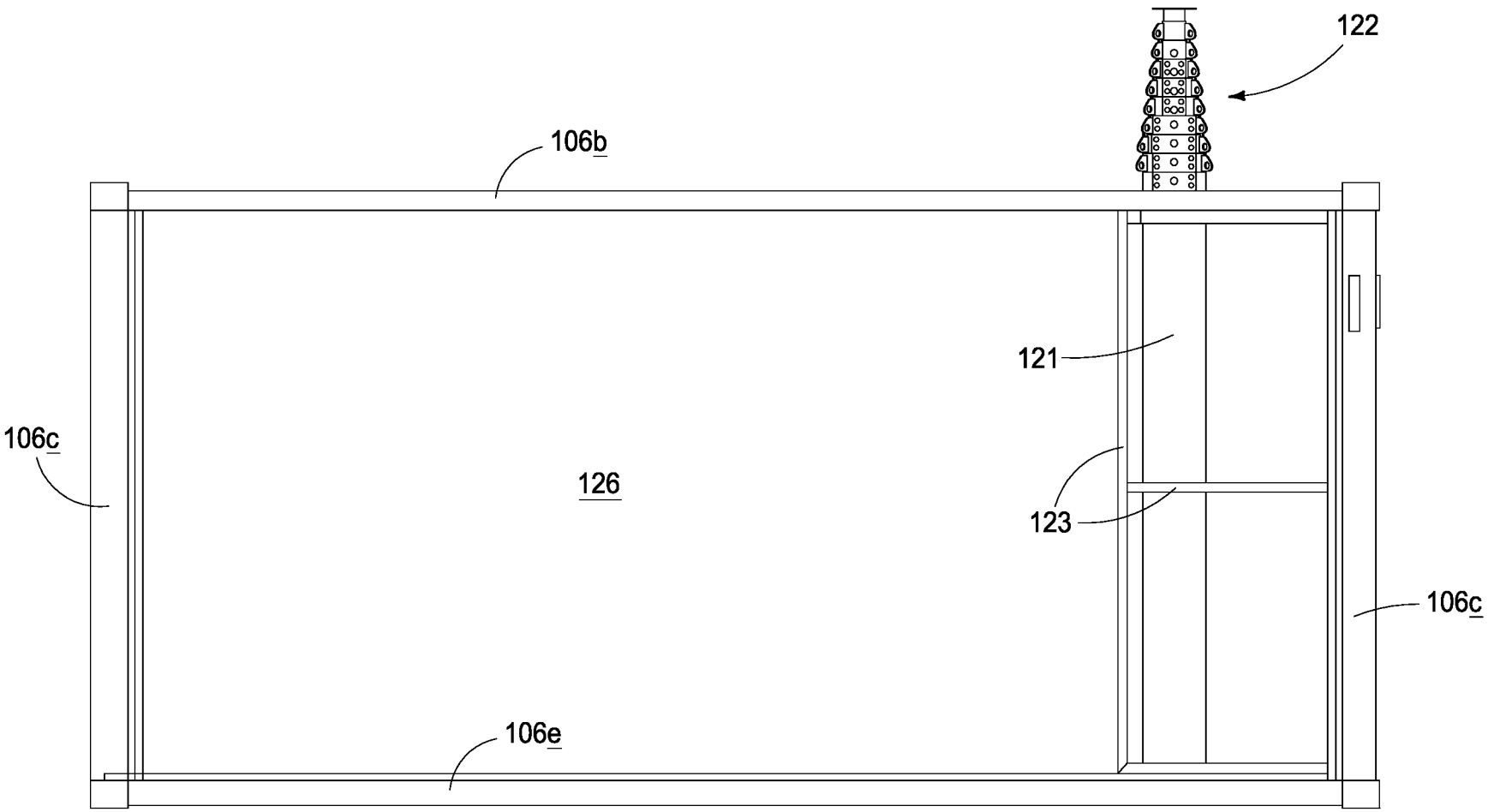
FIG. 3 is a rear inside elevation view of the example of the embodiment illustrated in FIG. 2.

FIG. 3 is a rear inside elevation view of the example of the embodiment illustrated in FIG. 2, illustrating upper framework portion 106*b*, corner framework portions 106*c*, internal compartment 126, tower 121 (including a proportion 122 of tower) and internal framework 123.

Figure 4:
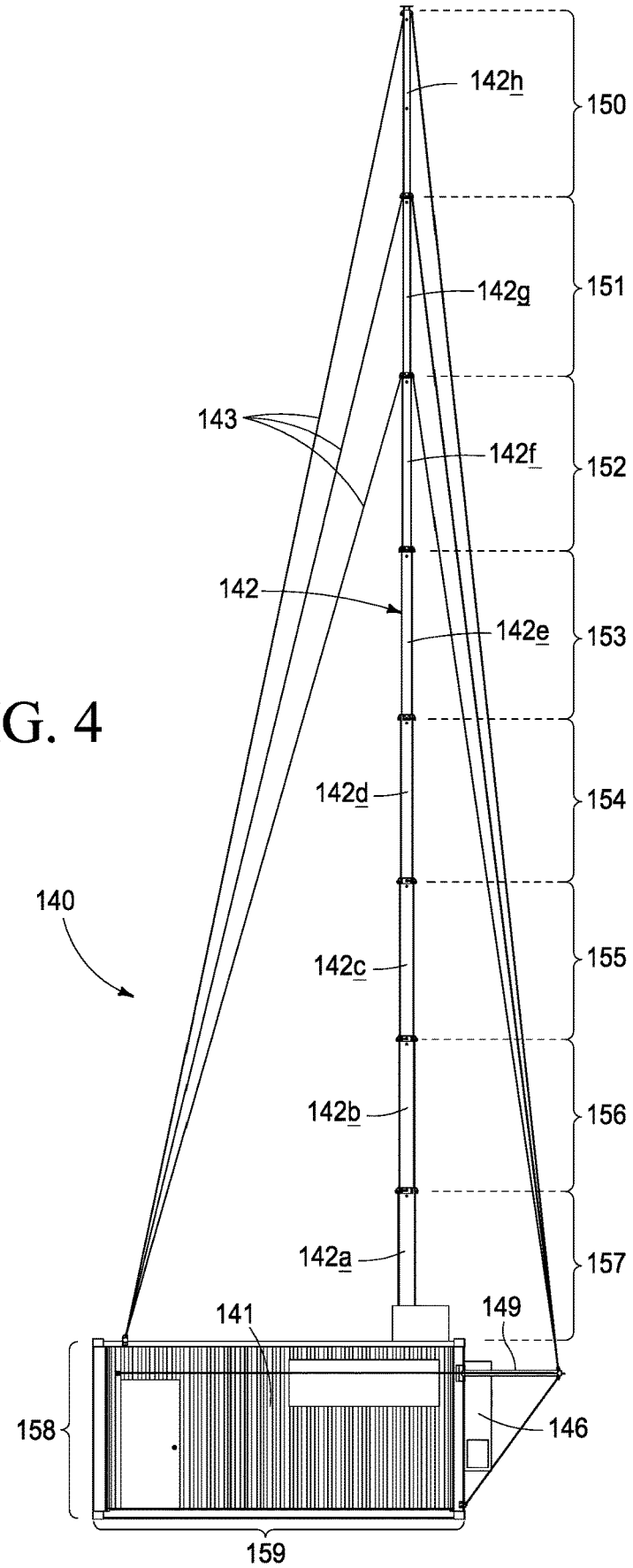
FIG. 4 is a front elevation view of an example of embodiment of a tower and container, with the tower in its extended position.

FIG. 4 is a front elevation view of an example of embodiment of this invention 140 including a tower 142 and a shipping container 141, with the tower 142 in its extended position. FIG. 4 illustrates the several sections or portions of tower 142, namely first tower section 142*a* (which has approximate height 157), second tower section 142*b* (which has approximate height 156), third tower section 142*c* (which has approximate height 155), fourth tower section 142*d* (which has approximate height 154), fifth tower section 142*e* (which has approximate height 153), sixth tower section 142*f* (which has approximate height 152), seventh tower section 142*g* (which has approximate height 151) and eighth tower section 142*h* (which has approximate height 150). The tower is supported by guide wires 143. The modified shipping container 141 as a height 158, length 159 and is showing with guide wire support structure 149 and power structure ancillary equipment 146 attached thereto.

FIG. 4 illustrates how the tower 142 may be mounted within into the shipping container 141 which would then act in part as a support structure as well as a containment structure for the tower in its operating location.

Figure 5:
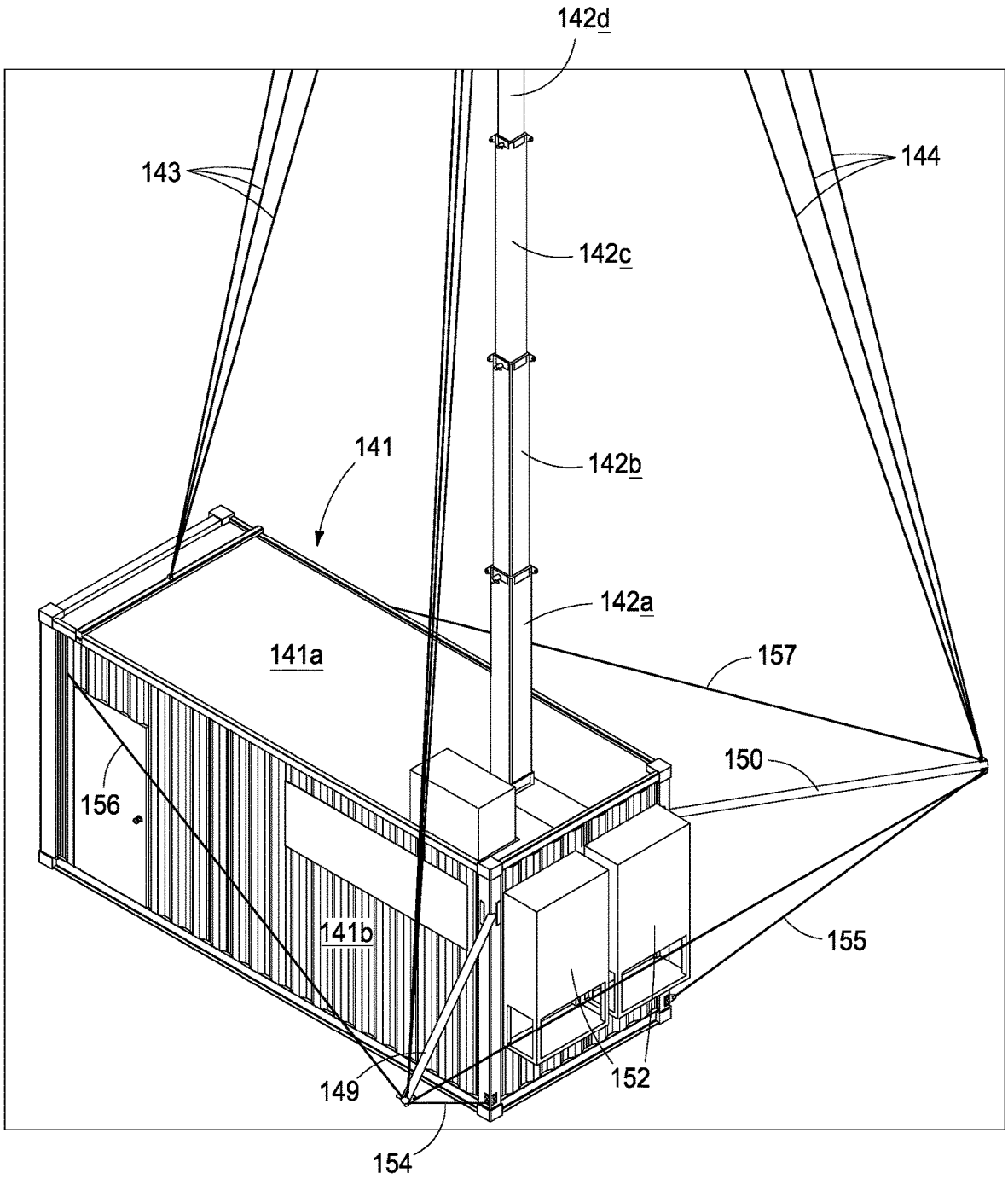
FIG. 5 is a partial perspective view of the example of the embodiment illustrated in FIG. 4.

FIG. 5 is a partial perspective view of the example of the embodiment illustrated in FIG. 4, illustrating as modified in this embodiment, shipping container top 141*a*, guide wires 143 and 144, front 141*b* of shipping container 141, FireWire support framework 149 and 150, with framework support cables 154 and 157 shown attached to perspective framework components 149 and 150. FIG. 5 also shows first tower section 142*a*, second tower section 142*b*, and third tower section 142*c*.

Figure 6:
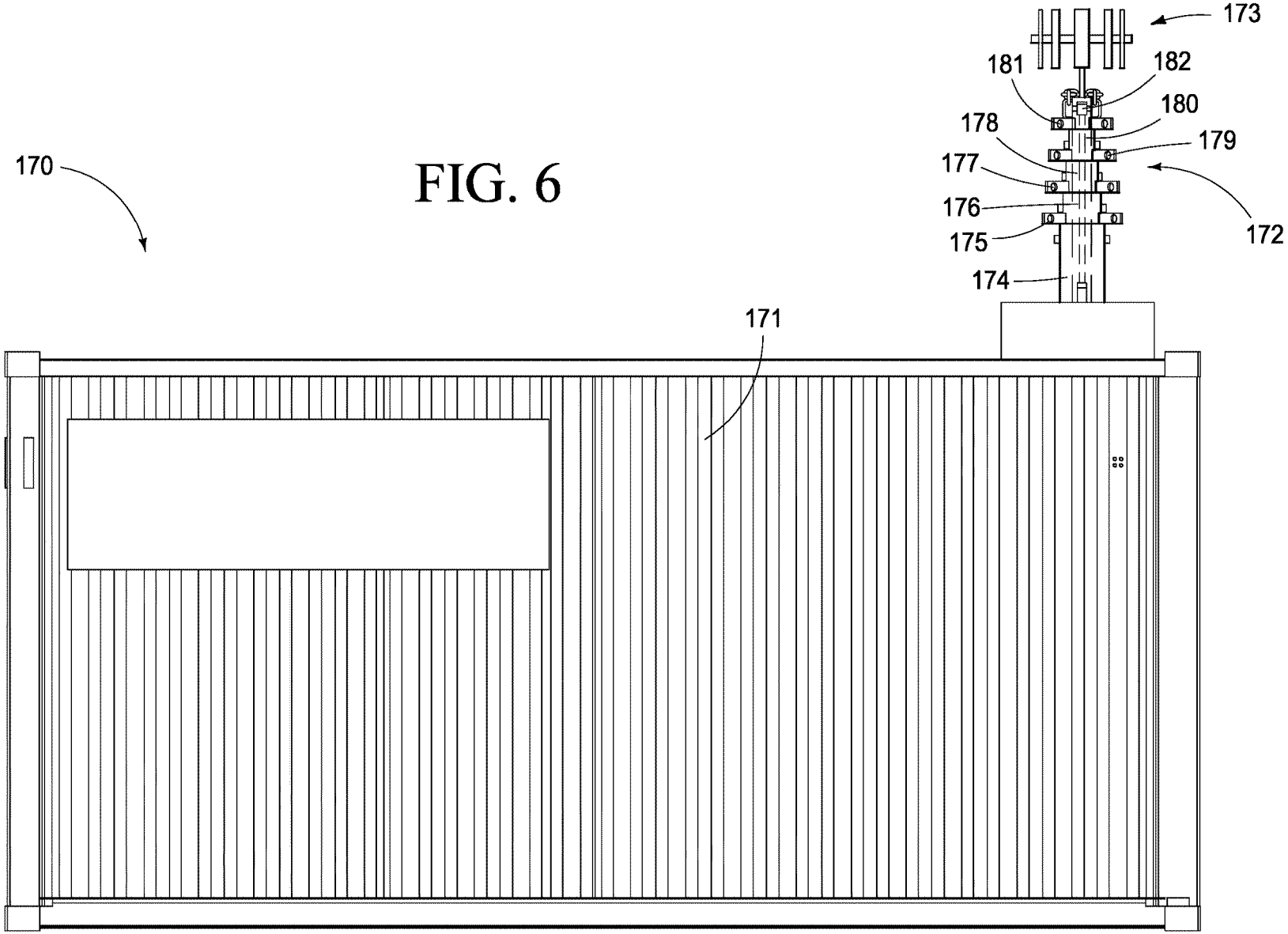
FIG. 6 is an exterior elevation view of embodiment of this invention before the tower has been placed into a vertical position.

FIG. 6 is an exterior elevation view of an embodiment of this invention after the tower 172 (not shown in this figure) has been placed into a vertical position, illustrating modified shipping container 170 (including front panel 171 of shipping container 170. FIG. 6 further illustrates, antenna 173 on the un-extended Tower 172, first tower section 174 with attachment structure 175, second tower section 176 with attachment structure 177, third tower section 178 with attachment structure 179, four tower section 180 with attachment structure 181 and the upper end 182 of a hydraulic ram as further illustrated and discussed relative to later figures below.

Figure 7:
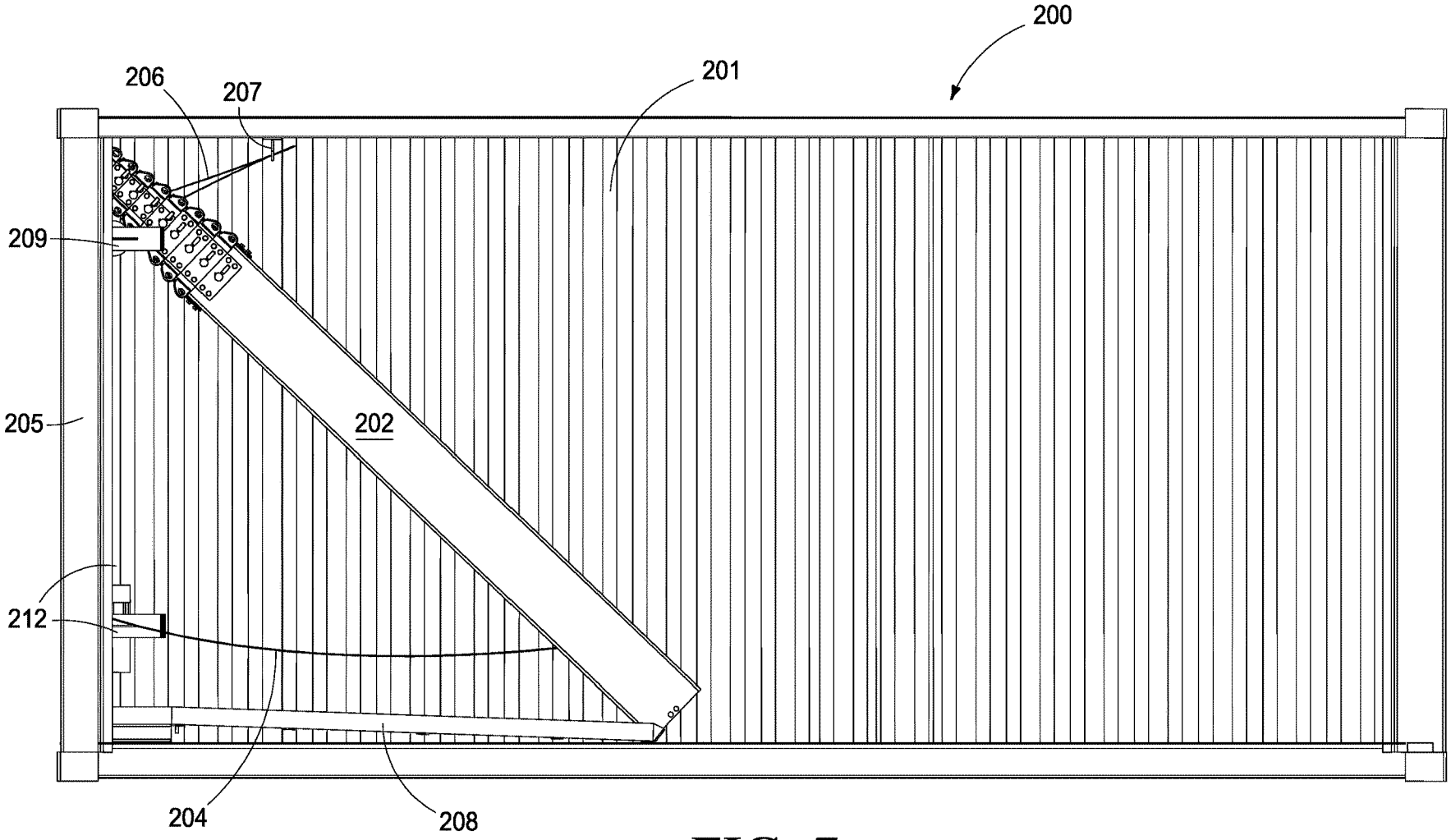
FIG. 7 is a front inside elevation view of an embodiment of a tower being maneuvered from a stored or transport position toward an upright or operational position.

FIG. 7 is a front inside elevation view of an embodiment of a tower 202 being maneuvered from a stored or transport position (within shipping container 200 with panel 201) toward an upright or operational position. The tower 202 is shown as it is being moved or placed in its vertical position by being slid along slide 208. Upper tower support structure 209 and lower tower support structure 212 are shown attached to an end wall of the shipping container 200, and also illustrates corner support 205. Support for pulling cable 204 is illustrated in FIG. 7, along with support cable 206 attached to and supported by cable support 207 which is mounted to the shipping container 200. A wench may be included as part of the lower support structure 212 to assist in moving tower 202

Figure 8:
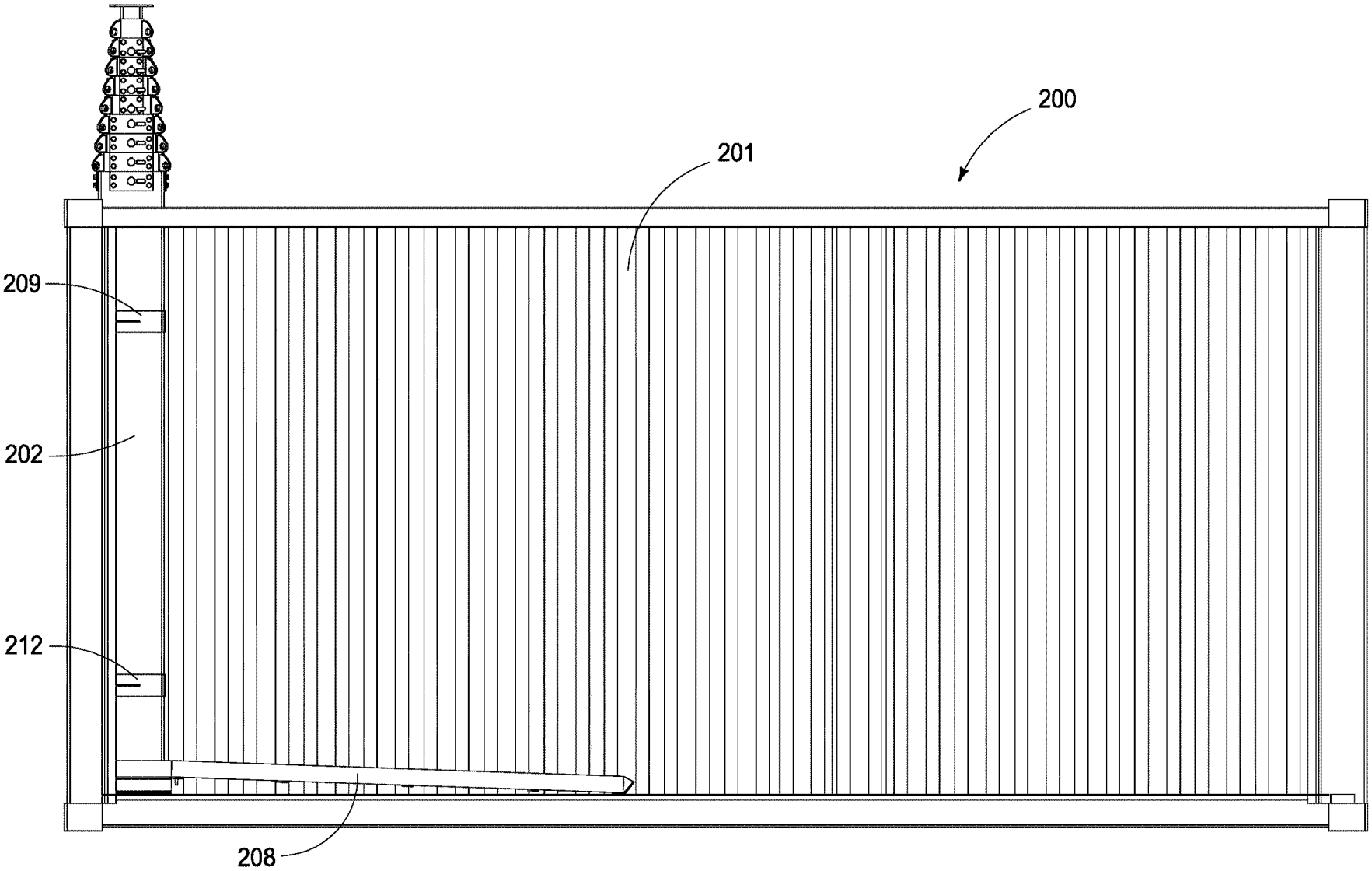
FIG. 8 is a front inside elevation view of the embodiment of the invention illustrated in FIG. 7, wherein the tower is mounted in the vertical position.

FIG. 8 is a front inside elevation view of the embodiment of the invention illustrated in FIG. 7, wherein the tower 202 is mounted in the vertical position within modified shipping container 200. FIG. 8 further illustrates shipping container back panel 201, tower slide 208, upper tower mount bracket 209 and lower tower mount bracket 212. The tower 202 in FIG. 8 has been slid along slide 208 to be moved from a horizontal position within the shipping container 200 to the vertical position shown in FIG. 8, mounted and secured to an end wall of the shipping container 200.

Figure 9:
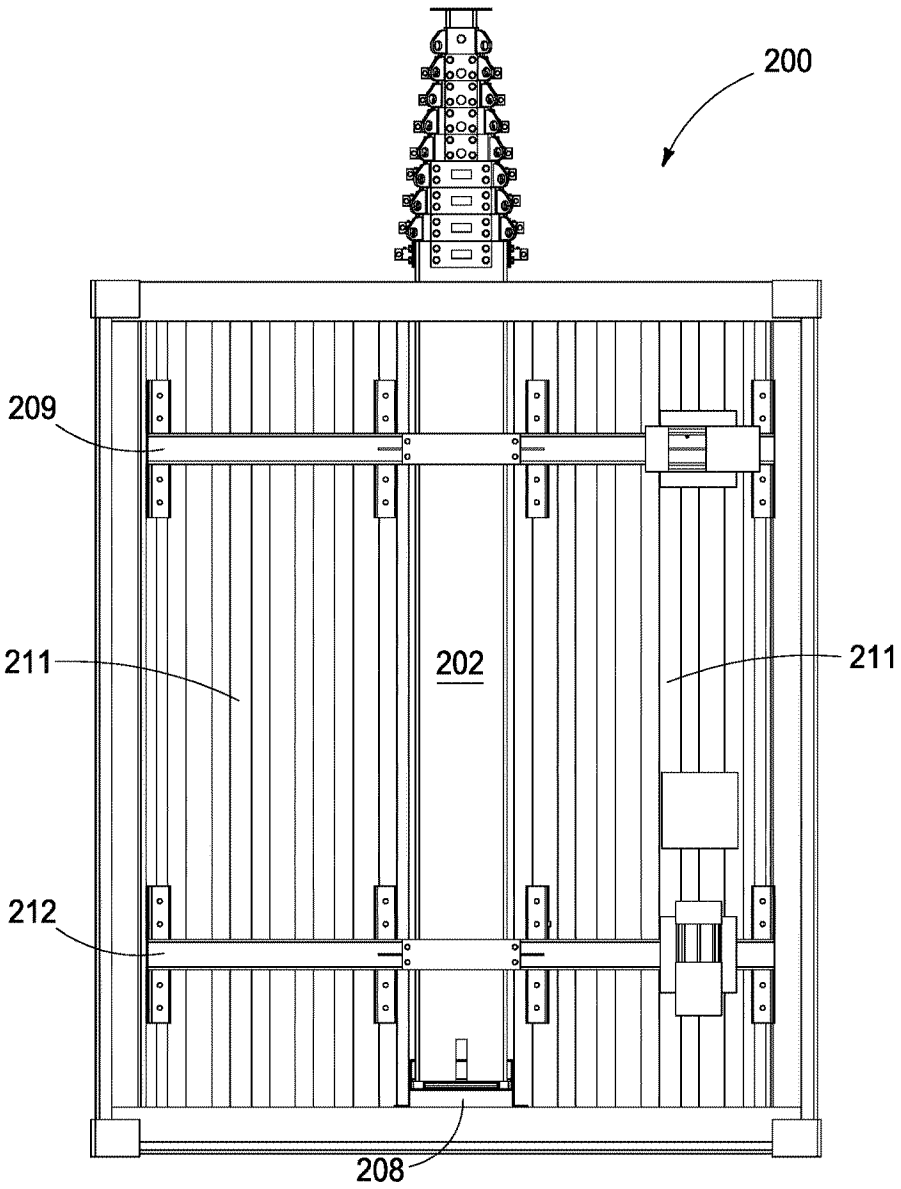
FIG. 9 is an end view of the embodiment of the invention illustrated in FIG. 7 and FIG. 8 above.

FIG. 9 is an end view of the embodiment of the invention illustrated in FIG. 7 and FIG. 8 above, illustrating shipping container 200, slide 208, tower 202, upper mounting bracket 209, lower mounting bracket 212 and container end panel 211.

Figure 10:
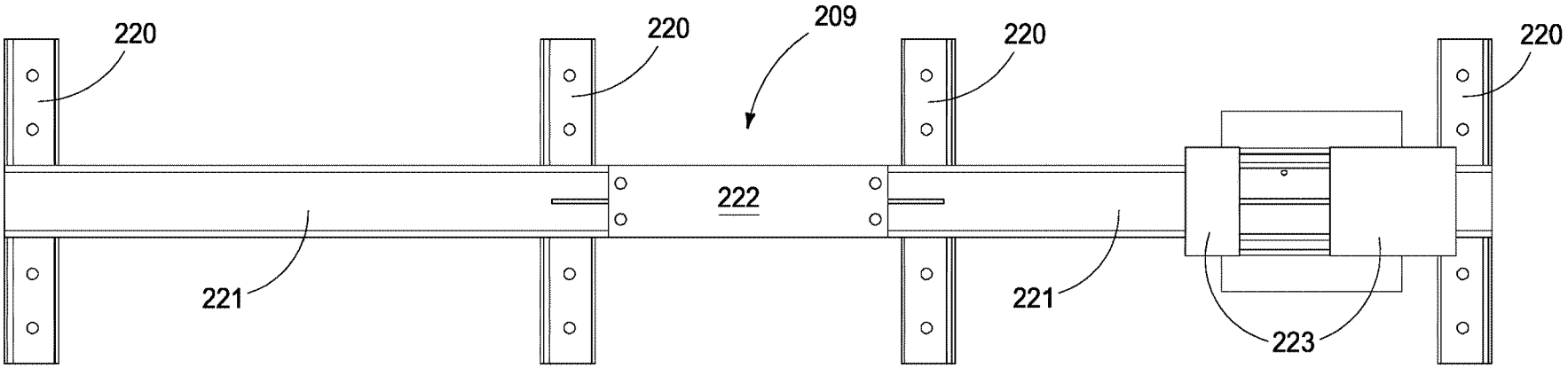
FIG. 10 is an elevation view of one example of an embodiment of an upper tower mount bracket that may be utilized in practicing aspects of this invention.

FIG. 10 is an elevation view of one example of an embodiment of an upper tower mount bracket 209 that may be utilized in practicing aspects of this invention. FIG. 10 illustrates container attachment brackets 220, center support 221 which bridges across and attaches to the container attachment brackets 220, power mount plate 222 and winch 223. Winch 223 may be utilized in combination with a rope or cable to attach to or secure the tower in various positions.

Figure 11:
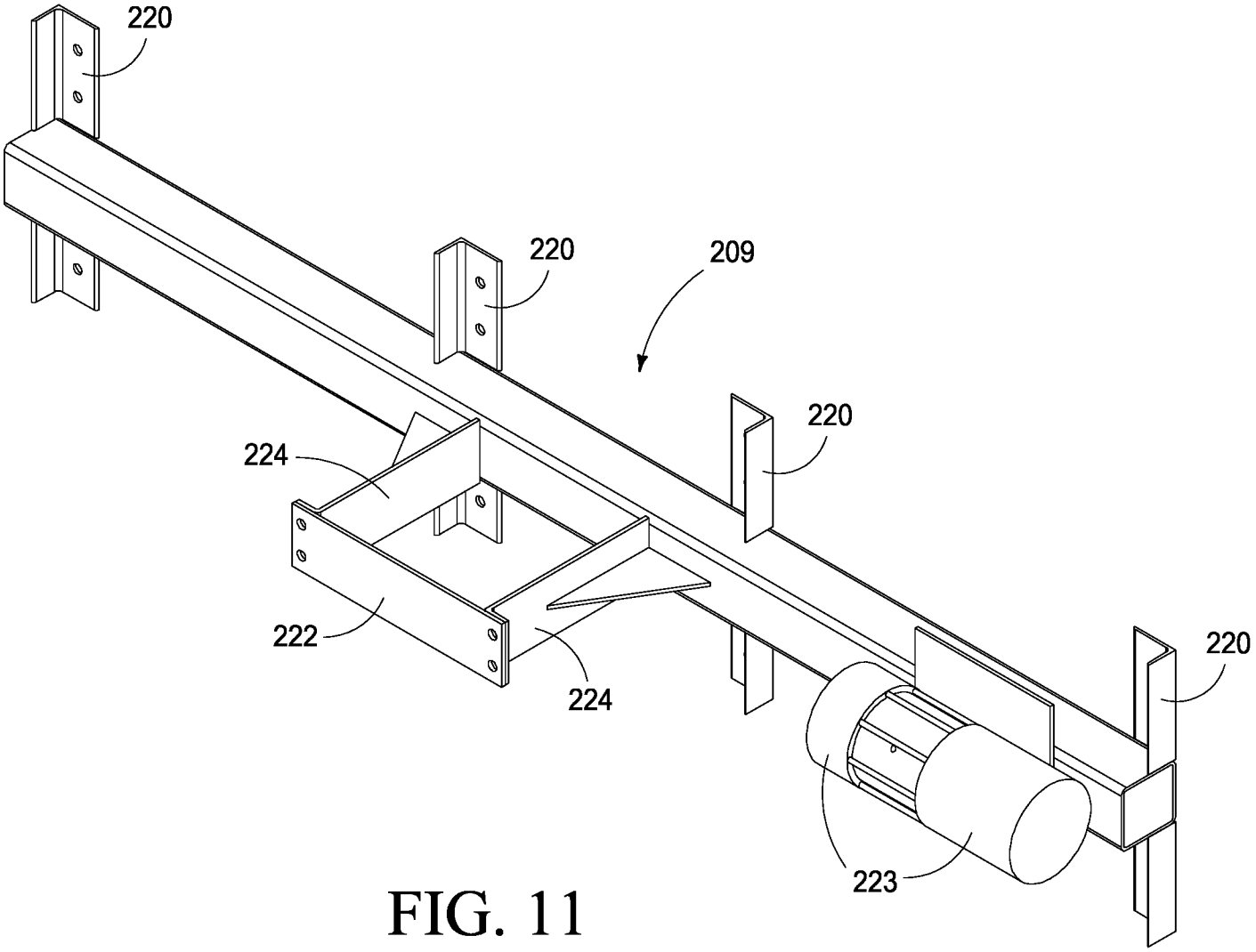
FIG. 11 is a perspective view of the embodiment of the upper tower mount bracket illustrated in FIG. 10.

FIG. 11 is a perspective view of the embodiment of the upper tower mount bracket 209 illustrated in FIG. 10. FIG. 11 further illustrates container attachment brackets 220, center support 221 which bridges across and attaches to the container attachment brackets 220, power mount plate 222 and winch 223. Winch 223 may be utilized in combination with a rope or cable to attach to or secure the tower in various positions.

Figure 12:
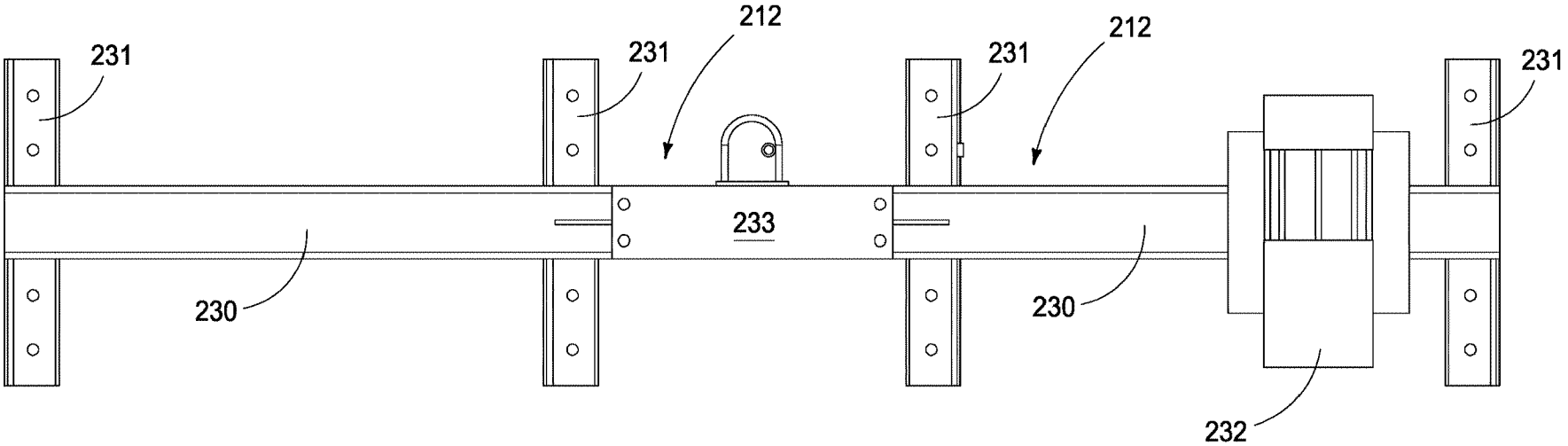
FIG. 12 is an elevation view of one example of an embodiment of a lower tower mount bracket that may be utilized in practicing embodiments of this invention.

FIG. 12 is an elevation view of one example of an embodiment of a lower tower mount bracket 212 that may be utilized in practicing embodiments of this invention. FIG. 12 illustrates container attachment brackets 231, center support 230, tower attachment plate 233 and wench 232.

Figure 13:
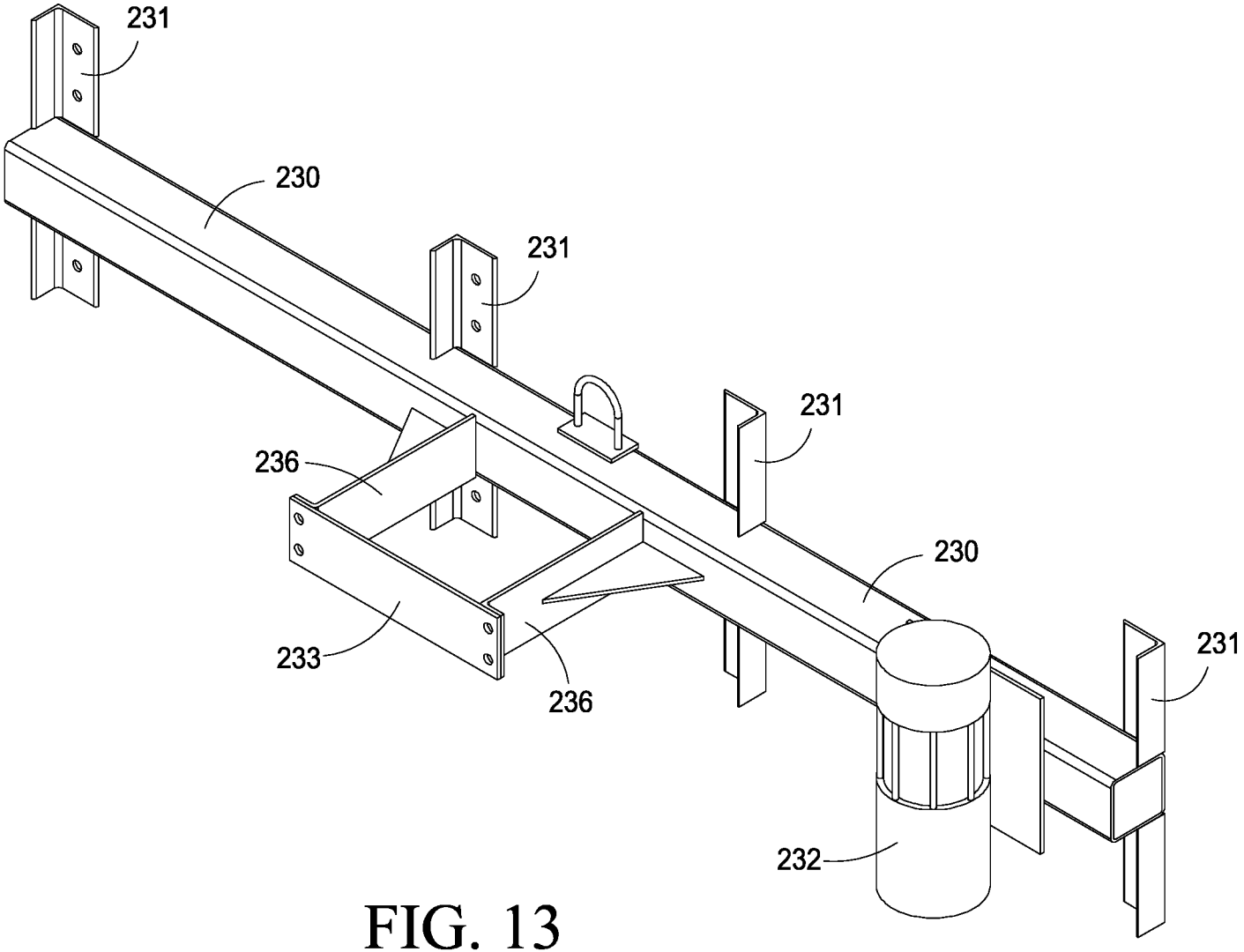
FIG. 13 is a perspective view of the example of the embodiment of the lower tower mount bracket illustrated in FIG. 12.

FIG. 13 is a perspective view of the example of the embodiment of the lower tower mount bracket illustrated in FIG. 12. FIG. 13 illustrates container attachment brackets 231, center support 230, tower attachment plate 233 (with attachment plate framework 236) and wench 232.

Figure 14:
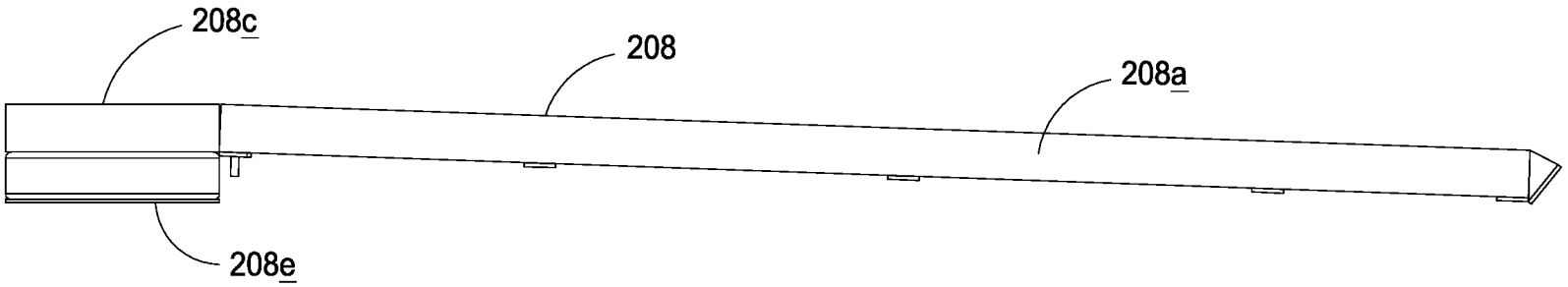
FIG. 14 is an elevation view of an example of an embodiment of a support slide ramp which may be utilized in practicing embodiments of this invention.

FIG. 14 is an elevation view of an example of an embodiment of a support slide ramp 208 which may be utilized in practicing embodiments of this invention, illustrating a first portion 208*a* and a second portion 208*c* of slide, along with tower support framework 208*e*.

Figure 15:
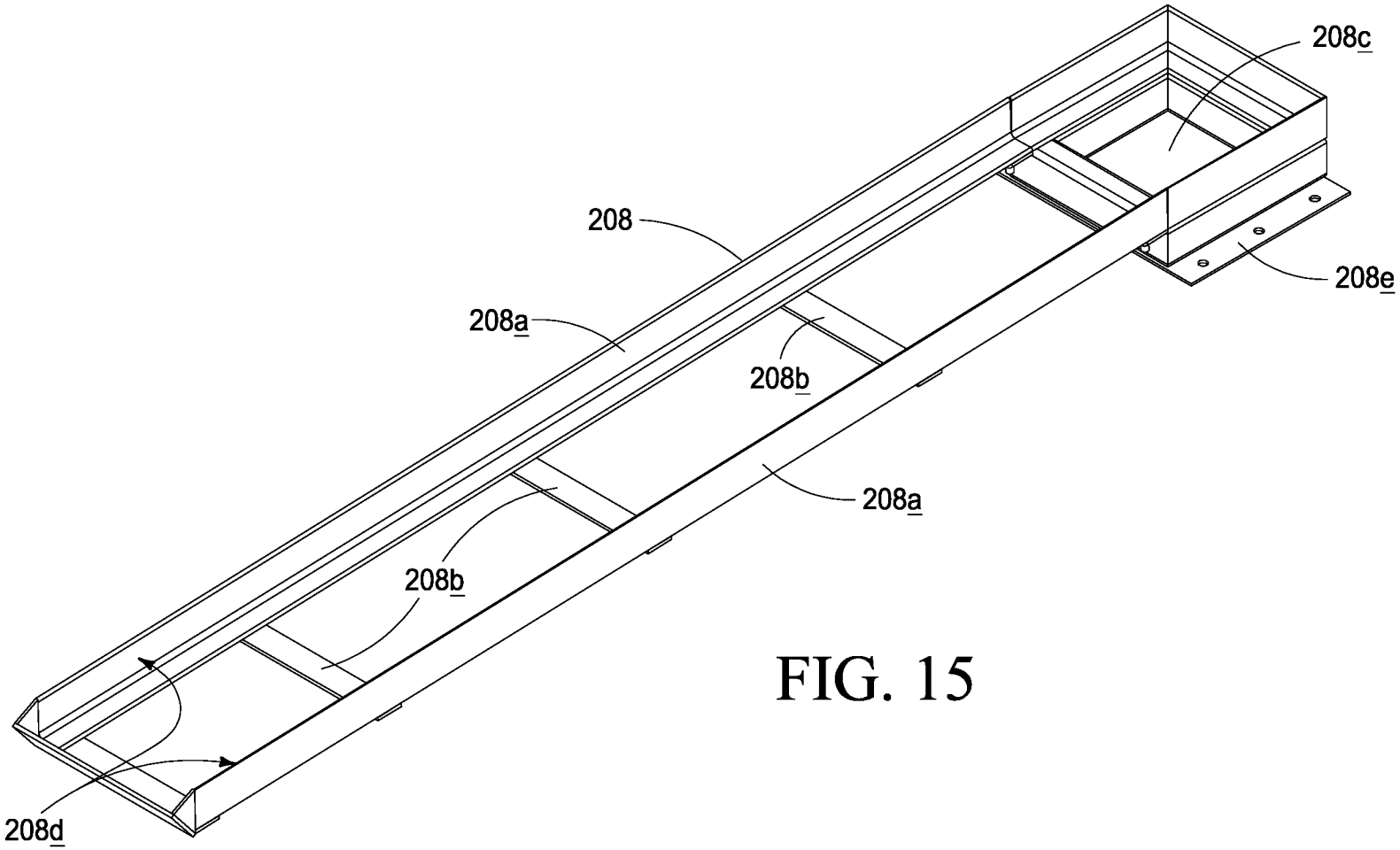
FIG. 15 is a perspective view of the embodiment of the support slide ramp illustrated in FIG. 14.

FIG. 15 is a perspective view of the embodiment the support slide ramp illustrated in FIG. 14; FIG. 15 illustrates a first portion 208*a* and a second portion 208*c* of slide, along with tower support framework 208*e* and internal service 208*d* and cross support members 208*b*.

Figure 16:
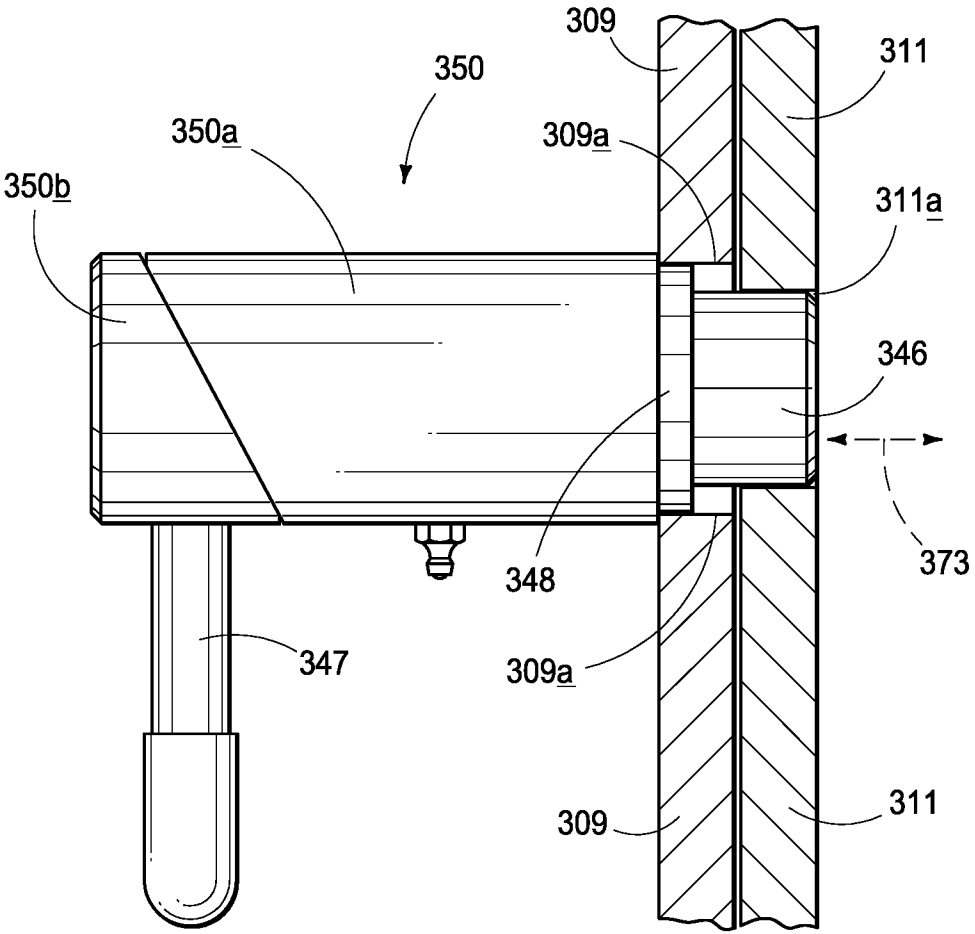
FIG. 16 is a front elevation view of an example of an embodiment of a spring 10 which may be utilized in practicing aspects of this invention.

FIG. 16 is a front elevation view of an example of an embodiment of a spring which may be utilized in practicing aspects of this invention. FIG. 16 is a front elevation view of the pin or spring that may be utilized in the expansion of the tower system illustrated in FIG. 1. FIG. 16 shows how spring pin 350 may be mounted by shoulder mount 348 to first tower structure 309 through aperture 309*a* in first tower structure 309. Second tower structure 311 is then shown positioned within first tower structure 309 and second tower structure aperture 311*a* is shown aligned with pin 346 such that pin 346 moved as shown by arrow 373 into second tower structure aperture 311*a*. Once pin 346 is inserted in the corresponding second tower structure aperture 311*a* it secures first tower structure 309 relative to second tower structure 311. If handle 347 is then rotated 180°, pin 346 is completely retracted within spring pin 350 and second tower structure 311 may be moved relative to first tower structure 309.

Figure 17:
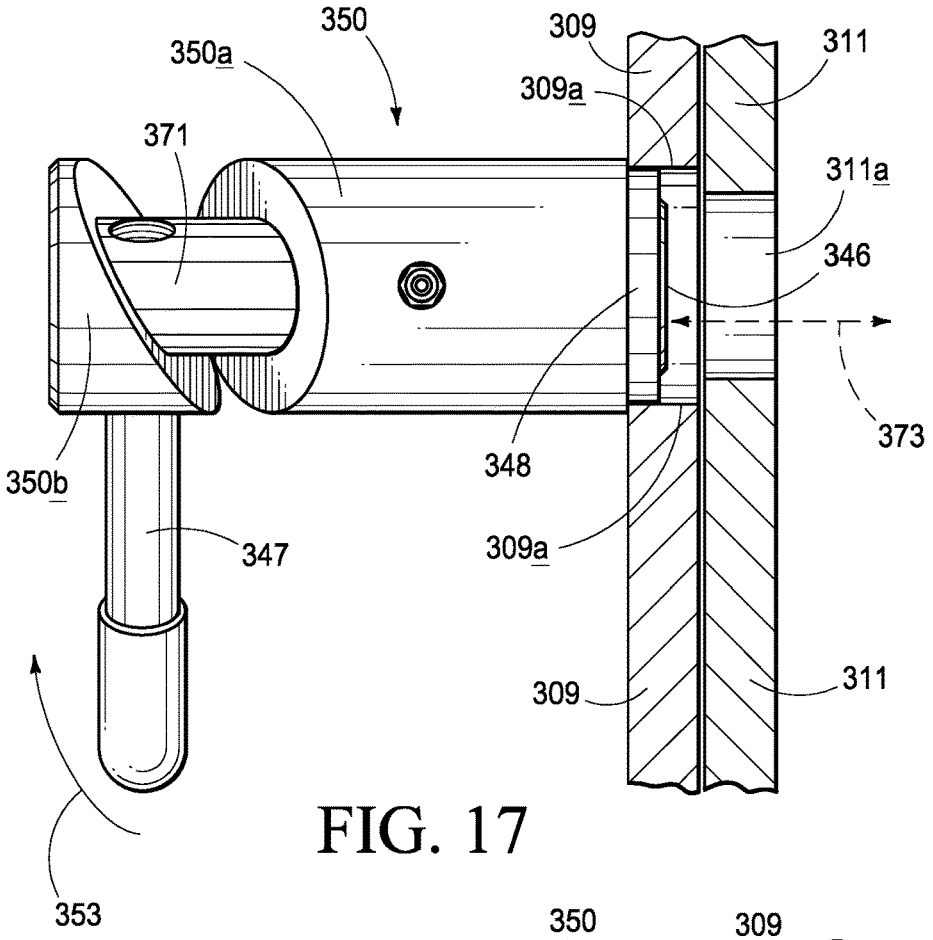
FIG. 17 is a front elevation view of the spring 10 illustrated in FIG. 16.
Figure 18:
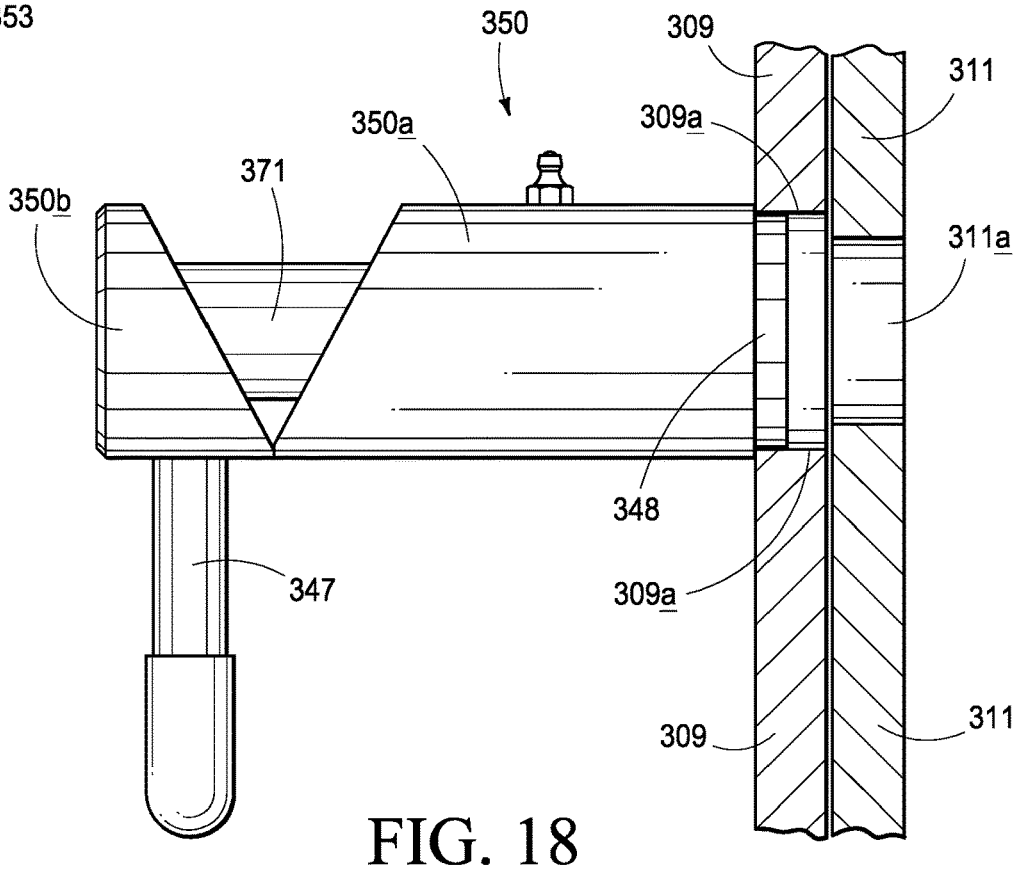
FIG. 18 is a front elevation view of the spring 10 illustrated above, with the handle fully rotated to its fully biased position.

FIG. 17 is a front elevation view of the spring 10 illustrated in FIG. 16. FIG. 17 is a front elevation view of the pin or spring that may be utilized in the expansion of the tower system illustrated herein, with the handle more fully rotated. FIG. 17 illustrates handle 347 rotated approximately 90°, with the corresponding of the retraction of pin 346 into shoulder mount 348. In FIGS. 16-18 it is illustrated how the retraction of pin 346 then provides for the relative or allows the relative movement of second tower structure 311 relative to first tower structure 309. It should be kept in mind that first tower structure 309 and second tower structure 311 as shown in FIG. 16 is just a cross section and second tower structure 311 is actually a similarly shaped component within the internal cavity of first tower structure 309.

While this particular configuration of spring pin is utilized, it will be appreciated by those of ordinary skill in the art that other biasing means for inserting attachment pins between tower structures may be utilized in the contemplation of this invention to provide for the secured expansion of one tower structure relative to another.

It is an advantage in using these pins a simple way to allow the relative securement of one tower structure relative to another so that the height of equipment, such as a boom truck with a boom that needs to reach the full height 386 as opposed to the reduced height 387 in order to fully extend and erect the tower system 300.

FIG. 18 is a front elevation view of the spring 10 illustrated above, with the handle fully rotated to its fully biased position. Like numbered items in FIG. 18 are the same as those identified in FIG. 17 and will not therefore be repeated herein.

Figure 19:
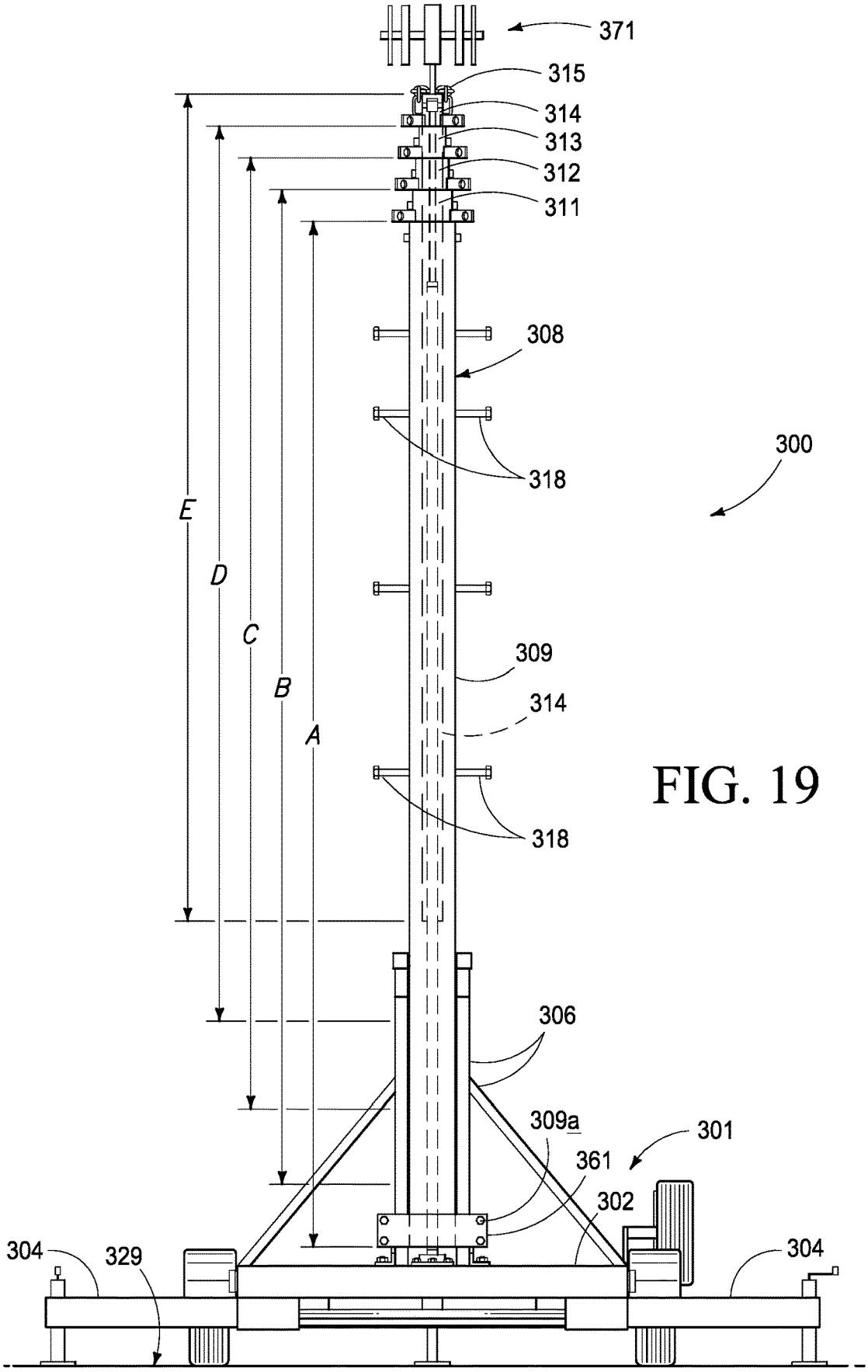
FIG. 19 is an elevation view of an embodiment of a tower system which may be utilized in practicing this invention, showing the hydraulic cylinder raising or extending the fifth tower structure relative to the fourth tower structure.

FIG. 19 is an elevation view of an embodiment of a tower system which may be utilized in practicing this invention, showing the hydraulic cylinder raising or extending the fifth tower structure relative to the fourth tower structure. FIG. 19 is a rear elevation view of an embodiment of a tower system which may be utilized in practicing the invention, showing the hydraulic cylinder 319 raising or extending the fifth tower structure relative to the fourth tower structure. In the embodiment of the invention shown in FIG. 19 where internal hydraulic cylinder 319 is utilized to raise the respective tower structures with respect to one another, a pin or other mechanism may be placed through apertures in the tubular wall of each, or across each to allow the hydraulic cylinder or top of the cylinder ram to engage it to raise that tower structure. After a given tower structure is raised to its extended position, the hydraulic cylinder ram may then be retracted back down to the next tower structure. Once the hydraulic cylinder is lowered down to or below the top of the next tower structure, a pin may be placed in that tower structure and that particular tower structure may then also be raised.

Figure 20:
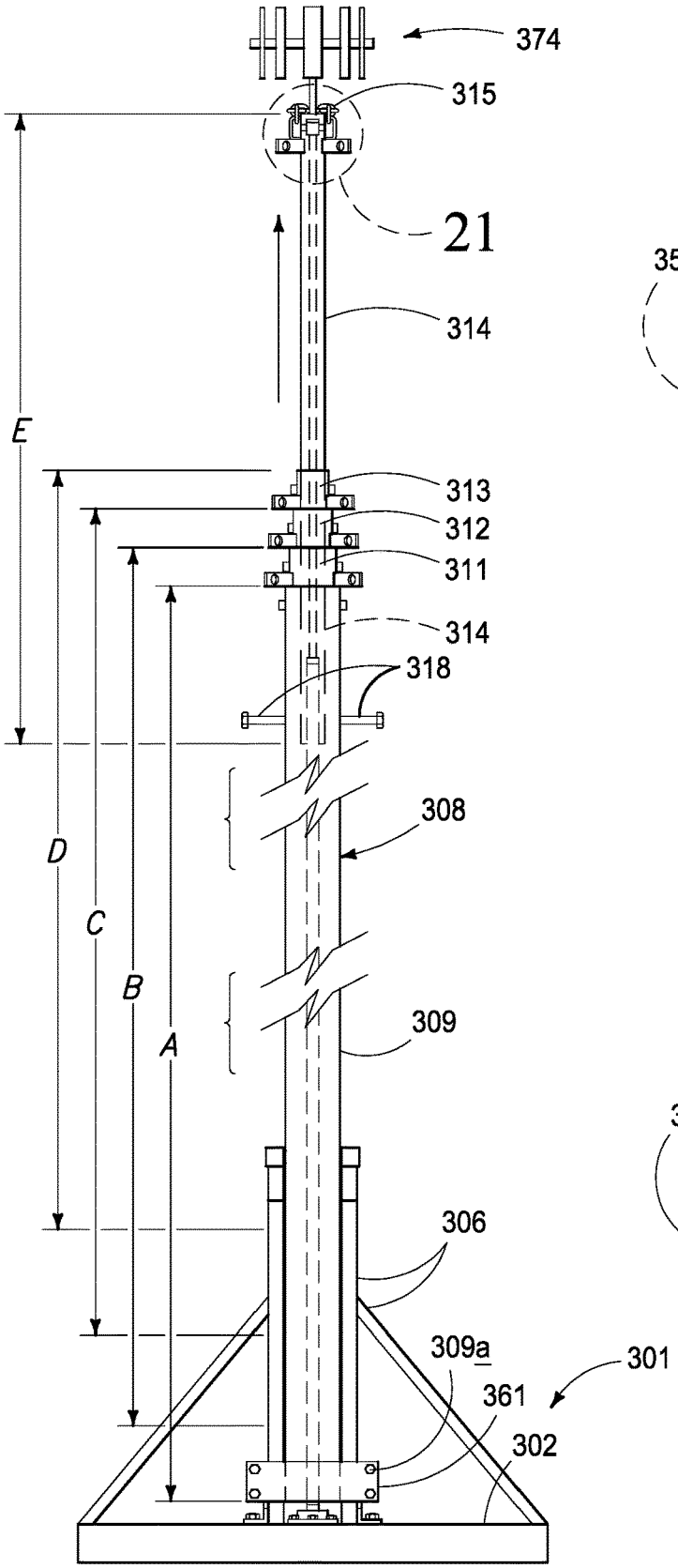
FIG. 20 is an elevation view of an embodiment of a tower system as shown in FIG. 19 with a stationary support structure.

The tower structures are raised until the spring pins engage the spring pin apertures on the tower structure within the internal cavity of that tower structure, thereby securely fixing one tower structure relative to an adjacent tower structure from further vertical movement. It will also be appreciated by those of ordinary skill in the art that one or more spring pins may be mounted on a given tower structure to help secure the tower structures with respect to one another, such as two spring pins, three spring pins or four spring pins around a given tower. FIG. 20 is the same elevation view as FIG. 19, only without the mobile support and components shown in FIG. 19, with like numbered items being the same as in FIG. 19.

Figure 21:
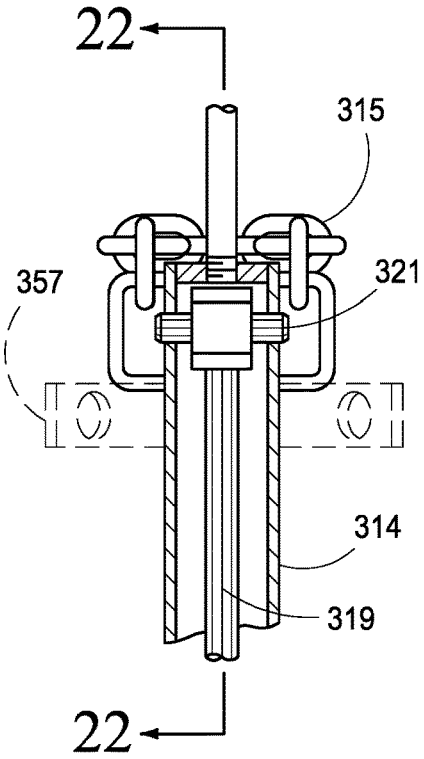
FIG. 21 is detail 21 from FIG. 20.

FIG. 21 is detail 21 from FIG. 20, and shows hydraulic cylinder ram 319 with pin 321 placed through pin apertures in fifth tower structure 314. The top of the hydraulic ram may include a V-shaped adapter 322 as shown in FIG. 21 to engage and push on pin 321 to move that tower structure upward. Once a given tower structure such as fifth tower structure 314 is moved and locked into its upward or extended position, then hydraulic cylinder ram 319 may be lowered down to a position below the fourth tower structure 313, a pin inserted into apertures to then engage or be engaged by the hydraulic cylinder ram 319 and its adapter 322. If this sequence or procedure is followed sequentially, each tower structure is then extended upward to a position which is fixed relative to the tower structure directly beneath it or directly surrounding it, and then the next in sequence is similarly raised, until the entire tower structure is erected at the desired height.

Figure 22:
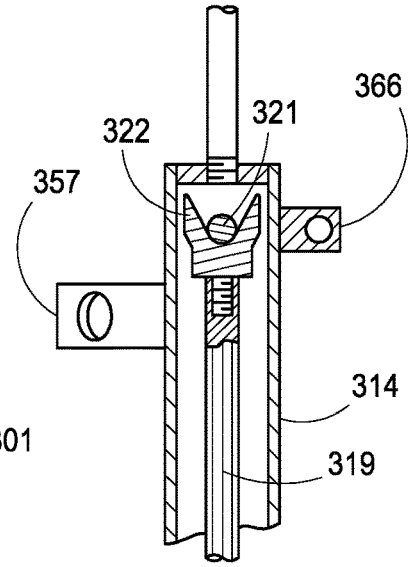
FIG. 22 is cross-sectional view 22-22 from FIG. 21.

FIG. 22 is a cross-sectional view 22-22 from FIG. 21, and shows the hydraulic cylinder ram 319 and adapter 322 in gauging pin 321 to raise fifth tower structure 314 upwardly. Guide wire support 357 includes an aperture through which a guide wire may be attached if additional stabilization is required or desired for that particular tower structure.

It will be appreciated by those of skill in the art that there may be other embodiments of the invention disclosed, such as a contained tower system comprising: a rigid transportation container; a tubular first tower structure mounted within the transportation container such that it is positionable in a substantially horizontal travel position and in a substantially vertical operational position, the first tower structure being tubular with a first tower structure internal cavity; a tubular second tower structure with a second tower structure internal cavity and which is slidably disposed within the first tower structure internal cavity, the second tower structure including a first tower spring aperture; a third tower structure slidably disposed within the second tower structure internal cavity; a first tower spring pin mounted to an outer surface of the first tower structure with an inwardly biased pin extending through a first spring pin aperture in the first tower structure; and such that when the second tower structure is slid to an extended position relative to the first tower structure, the biased pin of the first tower spring spring pins into the first tower spring aperture in the second tower structure to secure the second tower structure relative to the first tower structure.

Further embodiments to that in the preceding paragraph may include a tower system as recited the preceding paragraph, and: further wherein the second tower structure includes a second tower spring aperture, and further wherein the tower system further comprises a second tower spring pin mounted to an outer surface of the first tower structure with an inwardly biased pin extending through a second spring pin aperture in the first tower structure; and such that when the second tower structure is slid to its extended position relative to the first tower structure, the biased pin of the second tower spring pins into the second tower spring aperture to secure the second tower structure relative to the first tower structure; further comprising a second tower spring pin mounted to an outer surface of the second tower structure with an inwardly biased pin extending through a first spring pin aperture in the second tower structure; and such that when the third tower structure is slid to an extended position relative to the second tower structure, the biased pin of the second tower spring spring pins into the first tower spring aperture in the third tower structure to secure the third tower structure relative to the second tower structure; and/or further comprising a hydraulic cylinder mounted within the tower structures and disposed to slide the second tower structure with respect to the first tower structure.

In other and further method embodiments, a method of erecting a tower system is disclosed comprising: providing a rigid transportation container trailer; providing a tower framework pivotally mounted to the trailer chassis; providing a tubular first tower structure mounted to the tower framework positioned in a substantially horizontal travel position, the first tower structure being tubular with a first tower structure internal cavity and including a first tower spring pin mounted to an outer surface of the first tower structure with an inwardly biased pin extending through a first spring pin aperture in the first tower structure; providing a tubular second tower structure with a second tower structure internal cavity and which is slidably disposed within the first tower structure internal cavity, the second tower structure including a first tower spring aperture; and sliding the second tower structure outward from the internal cavity of the first tower structure until the biased pin of the first tower spring spring pins into the first tower spring aperture in the second tower structure to secure movement of the second tower structure relative to the first tower structure.

In yet another embodiment, a method of erecting a tower system is provided, comprising: providing a rigid transportation container with an internal cavity; providing a tower framework mounted within the internal cavity of the transportation container; providing a tubular first tower structure pivotally mounted to the tower framework positioned in a substantially horizontal travel position, the first tower structure being tubular with a first tower structure internal cavity and including a first tower spring pin mounted to an outer surface of the first tower structure with an inwardly biased pin extending through a first spring pin aperture in the first tower structure; providing a tubular second tower structure with a second tower structure internal cavity and which is slidably disposed within the first tower structure internal cavity, the second tower structure including a first tower spring aperture; providing a third tower structure slidably disposed within the second tower structure internal cavity; providing second tower spring pin mounted to an outer surface of the second tower structure with an inwardly biased pin extending through a first spring pin aperture in the second tower structure; sliding the third tower structure outward from the internal cavity of the second tower structure until the biased pin of the second tower spring pins into the first tower spring aperture in the third tower structure to secure movement of the third tower structure relative to the second tower structure; and sliding the second tower structure outward from the internal cavity of the first tower structure until the biased pin of the first tower spring pins into the first tower spring aperture in the second tower structure to secure the second tower structure relative to the first tower structure.

In a further embodiment to that disclosed in the preceding paragraph, a method of erecting a tower system is disclosed and further wherein an internal hydraulic cylinder is used to slide the third tower structure outward from the internal cavity of the second tower structure until the biased pin of the second tower spring spring pins into the first tower spring aperture in the third tower structure to secure movement of the third tower structure relative to the second tower structure.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A contained tower system comprising:

a rigid transportation container;

a first tower structure mounted within the transportation container such that the first tower structure is positionable in a substantially horizontal travel position and in a substantially vertical operational position, and the first tower structure being tubular with a first tower structure internal cavity;

a support structure mounted to an inside end wall of the transportation container, the support structure including a winch with a cable to move the first tower structure along a slide from the substantially horizontal travel position to the substantially vertical operational position;

a second tower structure with a second tower structure internal cavity, the second tower structure being slidably disposed within the first tower structure internal cavity, and the second tower structure being tubular and including a tower spring aperture;

a third tower structure slidably disposed within the second tower structure internal cavity; and a tower spring pin mounted to an outer surface of the first tower structure, the tower spring pin including an inwardly biased pin positioned to extend through a spring pin aperture in the first tower structure, wherein, when the second tower structure is in an extended position relative to the first tower structure, the inwardly biased pin of the tower spring pin extends into the tower spring aperture in the second tower structure to secure the second tower structure relative to the first tower structure.

2. A contained tower system as recited in claim 1, wherein the spring pin aperture in the first tower structure is a first spring pin aperture, the tower spring aperture in the second tower structure is a first tower spring aperture, and the tower spring pin is a first tower spring pin, wherein the second tower structure further includes a second tower spring aperture, and wherein the contained tower system further comprises a second tower spring pin mounted to an outer surface of the first tower structure with an inwardly biased pin positioned to extend through a second spring pin aperture in the first tower structure, and wherein, when the second tower structure is in the extended position relative to the first tower structure, the inwardly biased pin of the second tower spring pin extends into the second tower spring aperture to secure the second tower structure relative to the first tower structure.

3. A contained tower system as recited in claim 1, wherein the spring pin aperture in the first tower structure is a first spring pin aperture, the tower spring aperture in the second tower structure is a first tower spring aperture, and the tower spring pin is a first tower spring pin;

wherein the contained tower system further comprises a second tower spring pin mounted to an outer surface of the second tower structure with an inwardly biased pin extending through a first spring pin aperture in the second tower structure; and wherein, when the third tower structure is in an extended position relative to the second tower structure, the inwardly biased pin of the second tower spring pin extends into a second tower spring aperture in the third tower structure to secure the third tower structure relative to the second tower structure.

4. A contained tower system as recited in claim 1, and further comprising a hydraulic cylinder mounted within the first and second tower structures and disposed to slide the second tower structure with respect to the first tower structure.

5. A method of erecting a tower system, comprising:

providing a rigid transportation container trailer;

providing a tower framework pivotally mounted to a trailer chassis;

providing a first tower structure mounted to the tower framework positioned in a substantially horizontal travel position, the first tower structure being tubular with a first tower structure internal cavity and including a tower spring pin mounted to an outer surface of the first tower structure, the tower spring pin including an inwardly biased pin positioned to extend through a spring pin aperture in the first tower structure;

providing a support structure including a winch with a cable operable to move the first tower structure along a slide from the substantially horizontal travel position to a substantially vertical operational position;

providing a second tower structure with a second tower structure internal cavity, the second tower structure being slidably disposed within the first tower structure internal cavity, and the second tower structure being tubular and including a tower spring aperture; and sliding the second tower structure outward from the first tower structure internal cavity until the inwardly biased pin of the tower spring pin extends into the tower spring aperture in the second tower structure to secure movement of the second tower structure relative to the first tower structure.

6. A method of erecting a tower system, comprising:

providing a rigid transportation container with an internal cavity;

providing a tower framework mounted within the internal cavity of the transportation container;

providing a first tower structure pivotally mounted to the tower framework positioned in a substantially horizontal travel position, and the first tower structure being tubular with a first tower structure internal cavity and including a first tower spring pin mounted to an outer surface of the first tower structure with an inwardly biased pin positioned to extend through a first spring pin aperture in the first tower structure;

providing a support structure mounted to an inside end wall of the transportation container, the support structure including a winch with a cable to move the first tower structure along a slide from the substantially horizontal travel position to a substantially vertical operational position;

providing a second tower structure with a second tower structure internal cavity, the second tower structure being slidably disposed within the first tower structure internal cavity, and the second tower structure being tubular and including a first tower spring aperture;

providing a third tower structure slidably disposed within the second tower structure internal cavity;

providing a second tower spring pin mounted to an outer surface of the second tower structure, the second tower spring pin including an inwardly biased pin positioned to extend through a second spring pin aperture in the second tower structure;

sliding the third tower structure outward from the second tower structure internal cavity until the inwardly biased pin of the second tower spring pin extends into a second tower spring aperture in the third tower structure to secure movement of the third tower structure relative to the second tower structure; and sliding the second tower structure outward from the first tower structure internal cavity until the inwardly biased pin of the first tower spring pin extends into the first tower spring aperture in the second tower structure to secure the second tower structure relative to the first tower structure.

7. A method of erecting a tower system as recited in claim 6 wherein an internal hydraulic cylinder is used to slide the third tower structure outward from the second tower structure internal cavity until the inwardly biased pin of the second tower spring pin extends into the second tower spring aperture in the third tower structure to secure movement of the third tower structure relative to the second tower structure.

8. A method of erecting a tower system as recited in claim 7 wherein the internal hydraulic cylinder is used to slide the second tower structure outward from the internal cavity of the first tower structure until the inwardly biased pin of the first tower spring pin extends into the first tower spring aperture in the second tower structure to secure movement of the second tower structure relative to the first tower structure.

* * * * *